US009657463B2

(12) United States Patent
Ruvang

(10) Patent No.: US 9,657,463 B2
(45) Date of Patent: May 23, 2017

(54) WEAR MEMBER ATTACHMENT SYSTEM FOR EXCAVATION IMPLEMENT

(71) Applicant: BLACK CAT BLADES LTD., Edmonton (CA)

(72) Inventor: John A. Ruvang, Bartonville, TX (US)

(73) Assignee: BLACK CAT BLADES, LTD., Edmonton (CA)

( * ) Notice: Subject to any disclaimer, the term of this patent is extended or adjusted under 35 U.S.C. 154(b) by 0 days.

(21) Appl. No.: 15/058,256

(22) Filed: Mar. 2, 2016

(65) Prior Publication Data

US 2016/0356023 A1 Dec. 8, 2016

(51) Int. Cl.
*E02F 9/28* (2006.01)

(52) U.S. Cl.
CPC ..... *E02F 9/2816* (2013.01); *E02F 9/2883* (2013.01)

(58) Field of Classification Search
CPC ..... E02F 9/2833; E02F 9/2825; E02F 9/2841; E02F 9/2883; E02F 9/2816
USPC ..... 37/446, 452–460; 172/701.1–701.3; 403/370
See application file for complete search history.

(56) References Cited

U.S. PATENT DOCUMENTS

| | | | | |
|---|---|---|---|---|
| 2,618,873 | A | 11/1952 | Hostetter | |
| 4,192,089 | A | 3/1980 | Schwappach | |
| 4,433,496 | A * | 2/1984 | Jones | E02F 9/2833 24/580.1 |
| 5,088,214 | A | 2/1992 | Jones | |
| 5,311,681 | A | 5/1994 | Ruvang et al. | |
| 5,331,754 | A | 7/1994 | Ruvang | |
| 5,394,629 | A | 3/1995 | Ruvang et al. | |
| D363,074 | S | 10/1995 | Ruvang | |
| D365,109 | S | 12/1995 | Robinson et al. | |
| D365,577 | S | 12/1995 | Ruvang | |
| 5,564,206 | A | 10/1996 | Ruvang | |
| 5,713,145 | A | 2/1998 | Ruvang | |
| 5,718,070 | A | 2/1998 | Ruvang | |
| 5,743,031 | A | 4/1998 | Launder et al. | |
| 5,964,547 | A | 10/1999 | Brinkley | |
| 6,041,529 | A | 3/2000 | Ruvang | |
| 6,108,950 | A | 8/2000 | Ruvang et al. | |
| 6,194,080 | B1 | 2/2001 | Stickling | |
| 6,209,238 | B1 | 4/2001 | Ruvang | |

(Continued)

FOREIGN PATENT DOCUMENTS

WO 9316239 A1 8/1993

OTHER PUBLICATIONS

Search Report and Written Opinion issued Dec. 14, 2015 for International Application PCT/US15/34477, 11 pages.

(Continued)

*Primary Examiner* — Robert Pezzuto
(74) *Attorney, Agent, or Firm* — Smith IP Services, P.C.

(57) ABSTRACT

A wear member attachment system for an excavation implement can include a retainer with an abutment that engages a forward side of an opening extending through a lip of the excavation implement, the retainer further including a cam. Rotation of the cam displaces the abutment forward relative to a body of the retainer. Another wear member attachment system can include a retainer with a cam and an abutment. Rotation of the cam displaces the abutment outward relative to a body of the retainer. The abutment displacement is in a direction orthogonal to an axis of rotation of the cam.

29 Claims, 12 Drawing Sheets

(56) References Cited

U.S. PATENT DOCUMENTS

| | | | | |
|---|---|---|---|---|
| 6,301,810 | B1 * | 10/2001 | Fidler | E02F 9/2833 37/455 |
| 6,393,739 | B1 | 5/2002 | Shamblin et al. | |
| 6,439,796 | B1 | 8/2002 | Ruvang et al. | |
| 6,564,482 | B2 | 5/2003 | Ruvang | |
| 6,826,855 | B2 | 12/2004 | Ruvang | |
| 6,976,325 | B2 | 12/2005 | Robinson et al. | |
| 7,121,022 | B2 * | 10/2006 | Bierwith | E02F 9/2833 37/455 |
| 7,162,818 | B2 | 1/2007 | Ruvang et al. | |
| 7,174,661 | B2 | 2/2007 | Briscoe | |
| 7,516,564 | B2 | 4/2009 | Ruvang | |
| D602,505 | S | 10/2009 | Ruvang | |
| 7,681,341 | B2 | 3/2010 | Ruvang | |
| 8,302,333 | B2 | 11/2012 | Ruvang | |
| 8,458,931 | B2 | 6/2013 | Knight | |
| 8,776,408 | B2 * | 7/2014 | Stewart | E02F 9/2816 172/772 |
| 9,315,971 | B2 * | 4/2016 | LaHood | E02F 9/2841 |
| 2003/0167663 | A1 | 9/2003 | Champney | |
| 2008/0276500 | A1 | 11/2008 | Ruvang | |
| 2014/0366408 | A1 | 12/2014 | Campomanes | |

OTHER PUBLICATIONS

ESCO Corporation, Whisler Plus™ Adapter System, Mining Regional Training 2006 Presentation, 2006, 27 pages.

Hensley Adapter Drawings, dated at least as early as Apr. 19, 2010, 4 pages.

Search Report with Written opinion issued Mar. 23, 2012 for International Application No. PCT/US11/049440, 10 pages.

Canadian Office Action issued Mar. 1, 2017 for CA Patent Application No. 2,955,419, 5 pages.

* cited by examiner

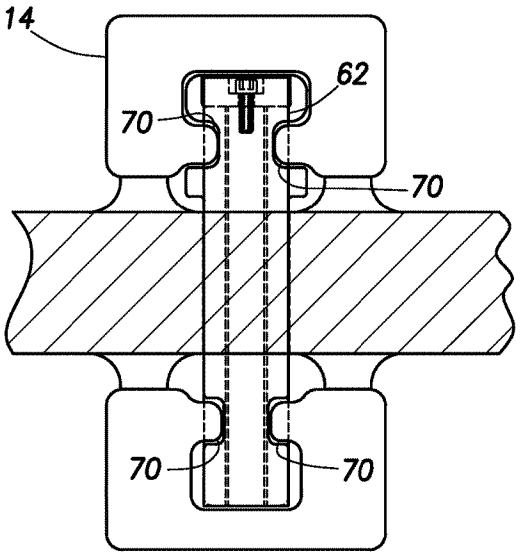
FIG.9
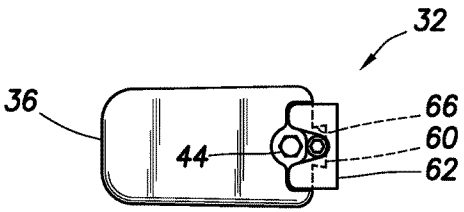
FIG.10
FIG.7
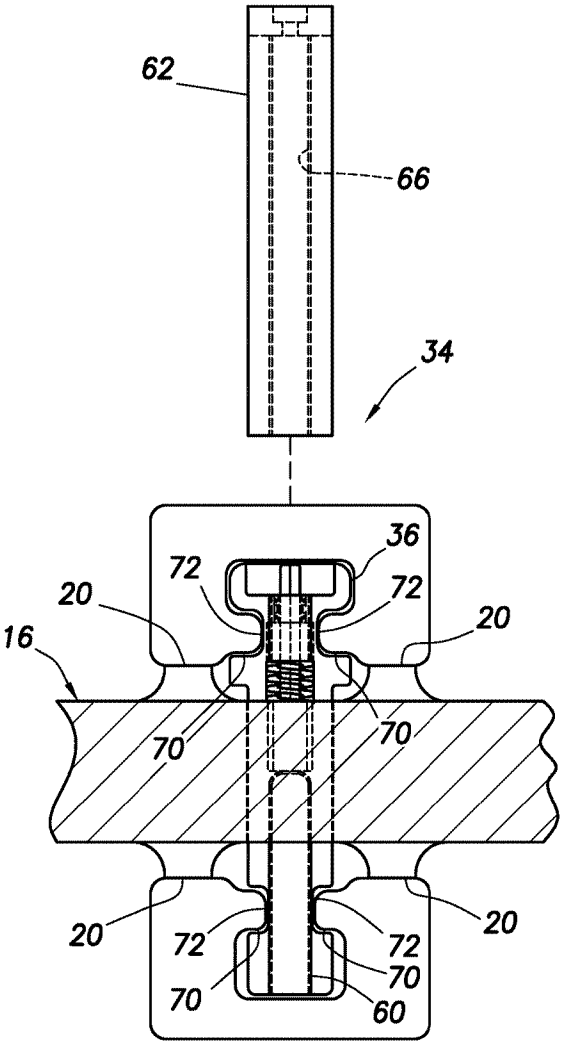

WEAR MEMBER ATTACHMENT SYSTEM FOR EXCAVATION IMPLEMENT

CROSS-REFERENCE TO RELATED APPLICATION

This application claims the benefit under 35 USC §119 of the filing date of International Application Serial No. PCT/US15/34477 filed 5 Jun. 2015. The entire disclosure of this prior application is incorporated herein by this reference.

BACKGROUND

This disclosure relates generally to equipment utilized and operations performed in conjunction with excavation and, in one example described below, more particularly provides a wear member attachment system for use with an excavation implement.

It can be useful to be able to conveniently install and replace wear members on excavation implements. However, the wear members should be attached in a manner that rigidly secures the wear members to an excavation implement, allows for subsequent wear, and provides for reliable detachment from the implement. Therefore, it will be readily appreciated that improvements are continually needed in the art of attaching wear members to excavation implements.

BRIEF DESCRIPTION OF THE DRAWINGS

FIG. 7 is a representative rear view of the adapter and retainer, taken along line 7-7 of FIG. 6.

FIG. 9 is a representative rear view of the adapter and retainer, taken along line 9-9 of FIG. 8.

FIG. 10 is a representative plan view of the retainer, with the latch installed.

DETAILED DESCRIPTION

Figure 1:
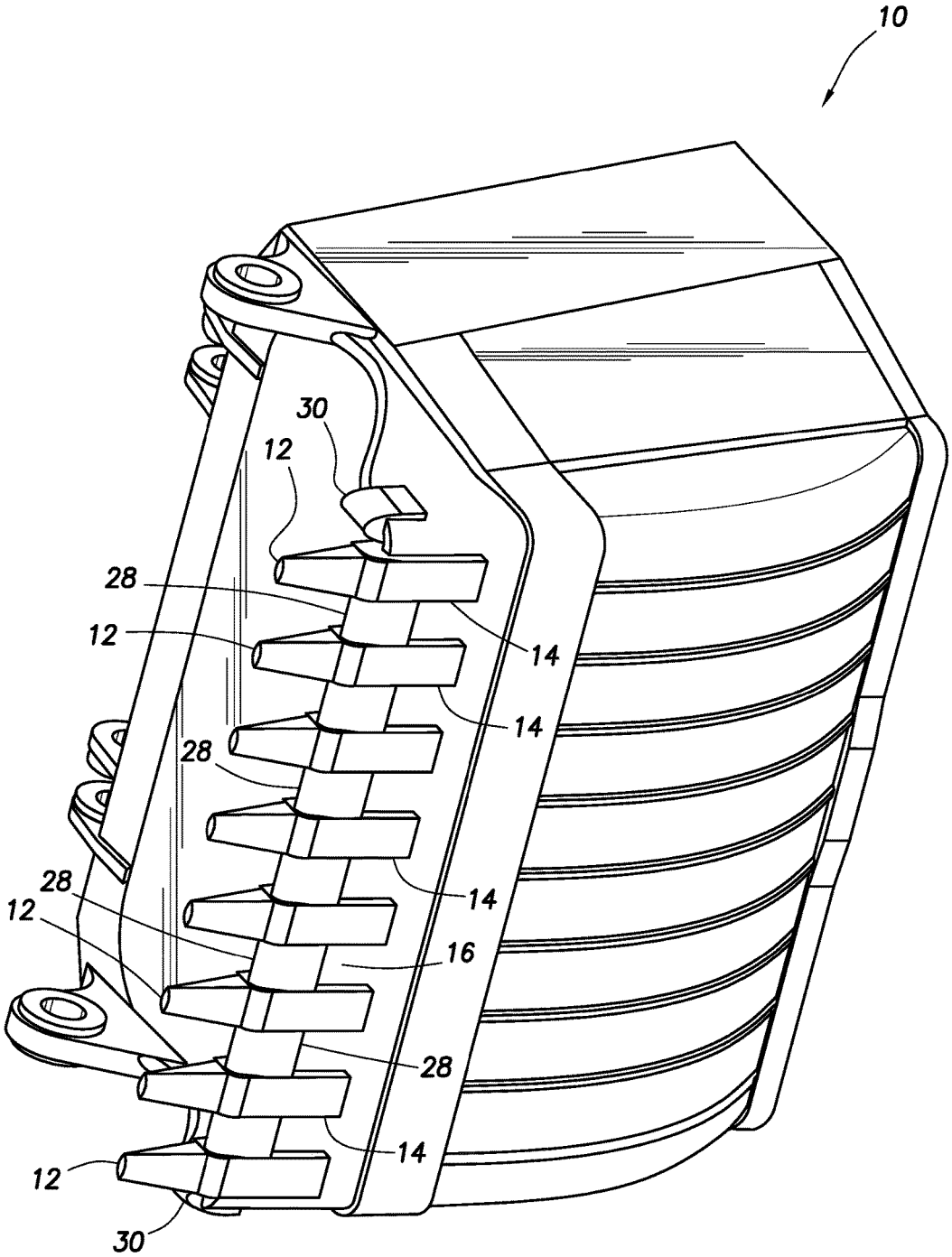
FIG. 1 is a representative perspective view of an example of an excavation implement which can incorporate a wear member attachment system embodying principles of this disclosure.

Representatively illustrated in FIG. 1 is an example of an excavation implement 10 which can embody principles of this disclosure. In the example of FIG. 1, the implement 10 is of the type known as a "dipper" or "bucket" of a cable shovel, but it should be clearly understood that the principles of this disclosure can be utilized with other types of excavation implements.

In the illustration of FIG. 1, the implement 10 is rotated so that an earth-engaging side of the implement is clearly visible. From this perspective, it may be seen that multiple teeth 12 are mounted on the implement 10 for piercing the earth.

These teeth 12 are typically rapidly worn down or otherwise damaged during use of the implement 10, and so replacement of the teeth should be conveniently, economically, rapidly and safely accomplished. These objectives are obtained, according to the principles of this disclosure, by use of specially configured adapters 14 which releasably secure the teeth 12 to a forward edge of a lip 16 of the implement 10.

The teeth 12 and adapter 14 are merely examples of wear members that can be securely and conveniently attached to an excavation implement using the principles of this disclosure. Other examples of wear members include shrouds 28, 30. Thus, the scope of this disclosure is not limited to use of any particular type of wear members.

Figure 2:
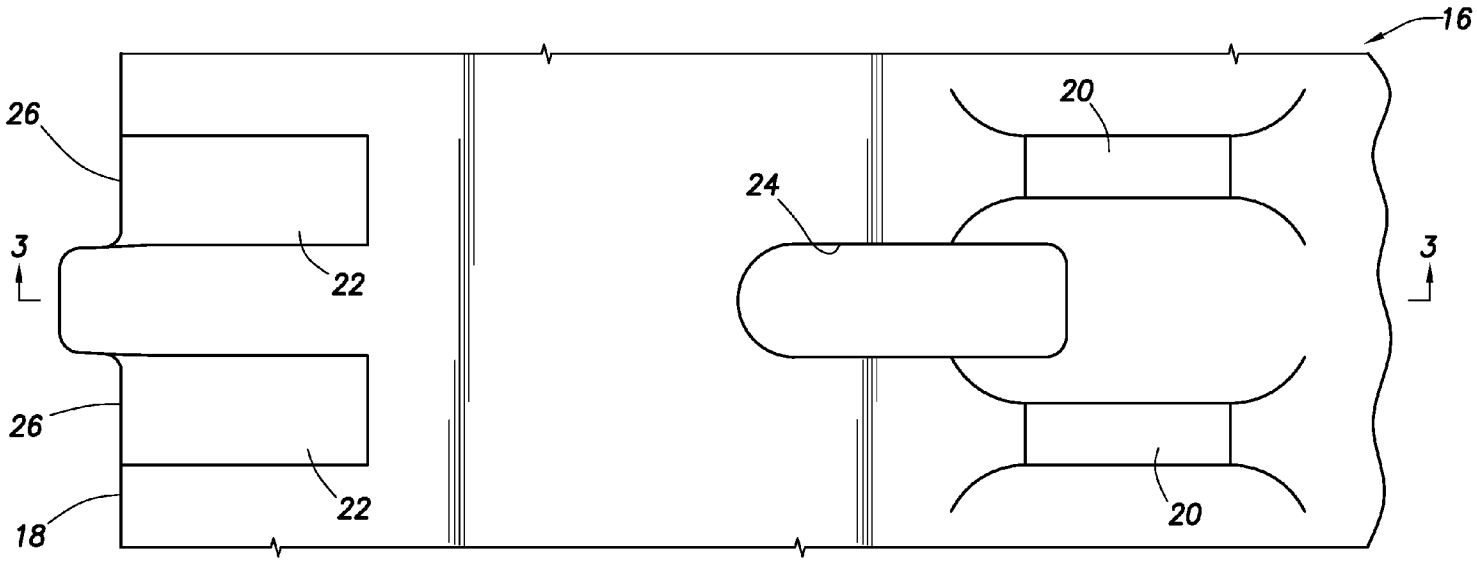
FIG. 2 is an enlarged scale representative plan view of a section of a lip which may be part of the implement of FIG. 1.

An enlarged scale plan view of a forward section of the lip 16 is representatively illustrated in FIG. 2. As used herein, the term "forward" is used to indicate a direction toward a front edge 18 of the lip 16, and the term "rearward" is used to indicate a direction away from the front edge of the lip.

The section of the lip 16 depicted in FIG. 2 is used to mount one of the adapters 14 to the lip. One of the lip sections is used to mount each of the adapters 14. Thus, the lip 16 includes a series of laterally spaced apart ones of the section shown in FIG. 2. Similar lip 16 sections may be used to mount each of the shrouds 28, 30. However, the scope of this disclosure is not limited to use of any particular type of lip sections for attachment of wear members.

Figure 3:
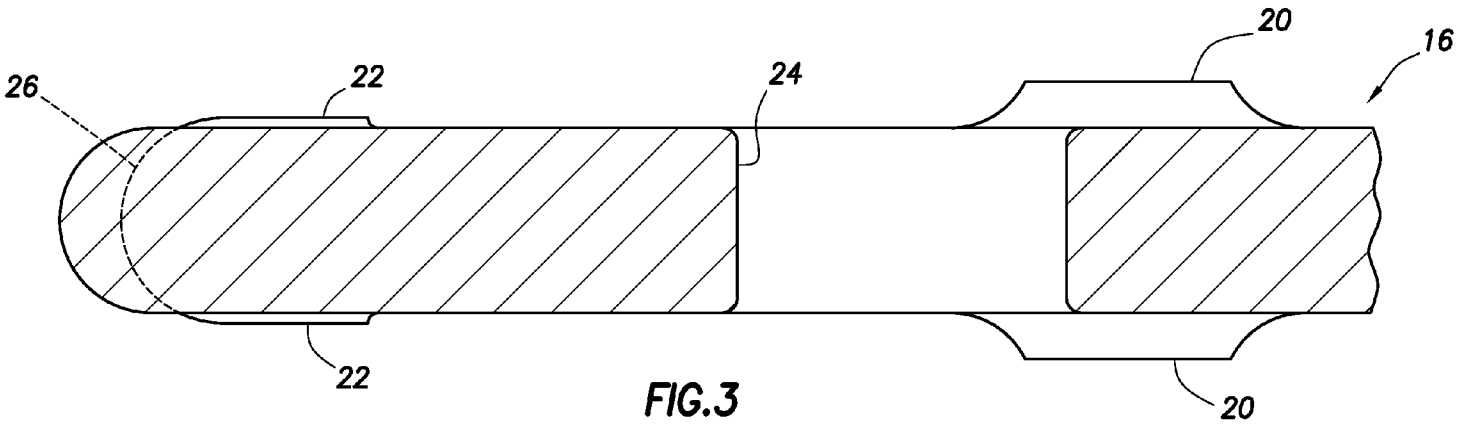
FIG. 3 is a representative cross-sectional view of the lip section, taken along line 3-3 of FIG. 2.

FIG. 3 illustrates a cross-sectional view of the section of the lip 16, taken along line 3-3 of FIG. 2. In this view, it may be seen that the lip 16 includes pads 20, 22 (known to those skilled in the art as "fit pads"). An opening 24 extends through the lip 16 adjacent the pads 20.

The pads 20 on opposite sides of the lip 16 are preferably spaced apart from each other a known distance, and within a known dimensional tolerance. Similarly, the pads 22 on opposite sides of the lip 16 are preferably spaced apart from each other a known distance, and within a known dimensional tolerance, but also wrap around the front 18 of the lip 16 to provide a forward surface 26 which engages and pushes the adapter 14 during earth-penetrating movement of the implement 10.

Figure 4:
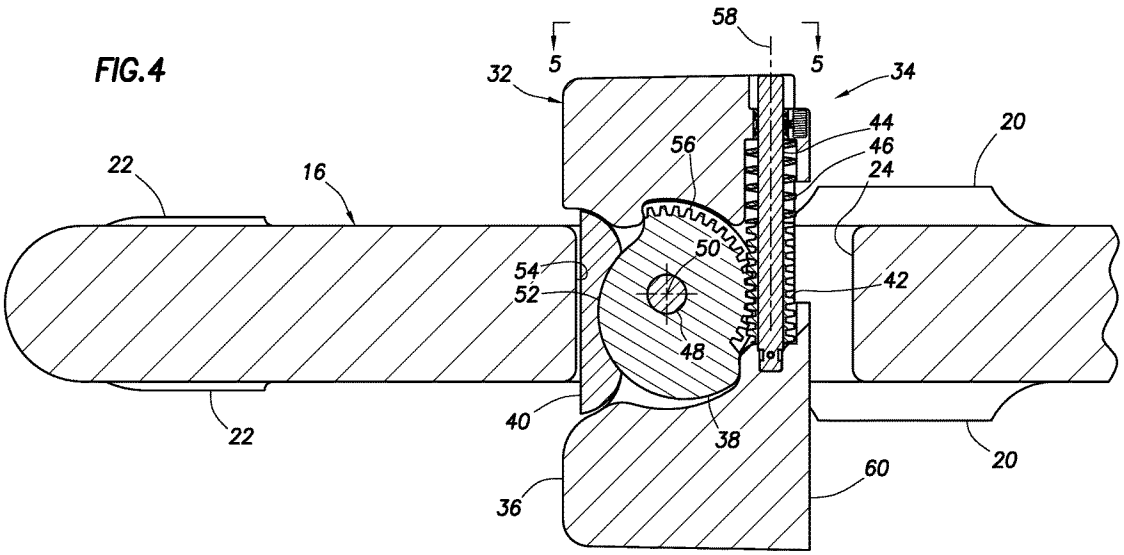
FIG. 4 is a representative cross-sectional view of an example of a retainer of the attachment system, the retainer being received in an opening in the lip section.

Referring additionally now to FIG. 4, an example of a retainer 32 of a wear member attachment system 34 is representatively illustrated. The retainer 32 is received in the opening 24 extending through the lip 16. The retainer 32 is used to securely and releasably attach a wear member (such as the adapter 14, shrouds 28, 30, etc.) to the lip 16.

In the FIG. 4 example, the retainer 32 includes a body 36, a cam 38, an abutment 40, a threaded member 42, a shaft 44 and a biasing device 46. The body 36 contains and supports the other elements, and may be constructed in any number of sections.

The cam 38 is rotatably mounted in the body 36, for example, by means of a pin 48 that extends laterally through the cam and body. Thus, the cam 38 rotates about an axis 50 that is oriented laterally relative to the implement lip 16.

The cam 38 has a spirally configured cam surface 52 formed thereon. The cam surface 52 engages the abutment 40. In this manner, rotation of the cam 38 causes displacement of the abutment 40.

As viewed in FIG. 4, the abutment 40 is in a retracted position, allowing the retainer 32 to be conveniently installed in the opening 24, and allowing a wear member to be installed on the lip 16, as described more fully below. Rotation of the cam 38 clockwise (as viewed in FIG. 4) will cause the abutment 40 to displace outward and forward relative to the body 36 of the retainer 32, so that the abutment eventually contacts a forward side 54 of the opening 24.

For rotation of the cam 38, the threaded member 42 is engaged with teeth 56 formed on the cam. Thus, rotation of the threaded member 42 about an axis 58 causes rotation of the cam 38. Note that the axis 58 is orthogonal to the axis 50, and so this arrangement is of the type known to those skilled in the art as a "worm drive." However, other arrangements (such as, other types of gear drives or other types of rotary actuators) may be used in other examples.

The threaded member 42 is rotated by rotating the shaft 44. For example, a hex configuration may be provided on the shaft 44 so that it can be rotated with common hand tools (such as a suitable ratchet and socket), a slot or Philips head could be provided on the shaft so that it can be rotated using a screwdriver, etc. The scope of this disclosure is not limited to any particular way of causing rotation of the shaft 44 and/or threaded member 42.

In the FIG. 4 example, the threaded member 42 can slide or reciprocate relative to the shaft 44. The shaft 44 has a hexagonal cross-sectional shape, and the threaded member 42 has a corresponding hexagonal interior shape. Thus, engagement between these hexagonal shapes prevents relative rotation between the threaded member 42 and the shaft 44, but permits the threaded member to displace axially on the shaft. Of course, other shapes may be used in keeping with the principles of this disclosure.

The biasing device 46 applies a downwardly (as viewed in FIG. 4) biasing force to the threaded member 42. Unless this biasing force is overcome, the threaded member 42 remains in this FIG. 4 position.

Figure 5:
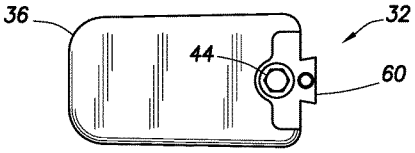
FIG. 5 is a representative plan view of the retainer, taken along line 5-5 of FIG. 4.

Referring additionally now to FIG. 5, a plan view of the retainer 32 is representatively illustrated. In this view, the hexagonal shape of the shaft 44 can be readily seen.

In addition, note that the body 36 has a "dovetail" shaped tenon 60 formed thereon. The tenon 60 is used to attach a latch to the body 36, as described more fully below.

Figure 6:
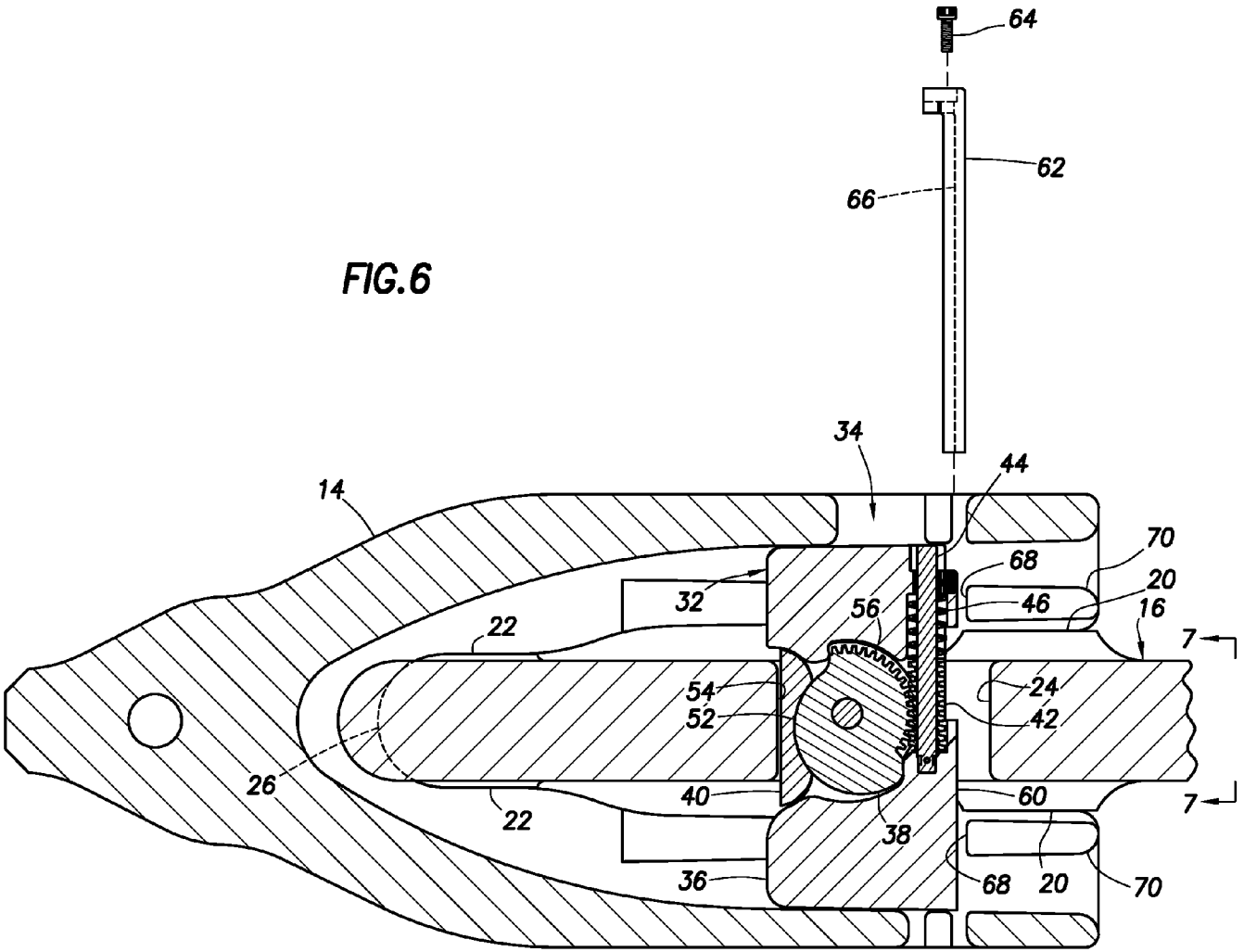
FIG. 6 is a representative cross-sectional view of an example of an adapter positioned on the lip section, with a latch being installed on the retainer.

Referring additionally now to FIG. 6, an adapter 14 is depicted as positioned on the lip 16. The adapter 14 has surfaces therein for engagement with the pads 20, 22. The retainer 32 serves to rearwardly bias the adapter 14, so that it maintains contact with the forward surface 26 of the lip 16, thereby securing the adapter to the lip and preventing or at least mitigating wear of the adapter and lip.

Note that the adapter 14 is used as an example of a wear member to demonstrate how the attachment system 34 can be used in practice. Other types of wear members may be attached using the system 34, in keeping with the principles of this disclosure.

As viewed in FIG. 6, a latch 62 is attached to the body 36 of the retainer 32. A fastener 64 is used to secure the latch 62 to the retainer body 36. The latch 62 has a dovetail shaped interior mortise 66 for cooperative engagement with the tenon 60 on the body 36.

The latch 62 is configured so that, after it has been secured to the retainer body 36, removal of the adapter 14 from the lip 16 is prevented. The latch 62 will engage shoulders 68 formed in the adapter 14 and thereby limit forward displacement of the adapter relative to the lip 16.

Referring additionally now to FIG. 7, a rear view of the adapter 14 positioned on the lip 16 is representatively illustrated. In this view it may be seen that inwardly extending projections 70 formed in the adapter 14 cooperatively engage slots 72 formed in the retainer body 36. The shoulders 68 (see FIG. 6) are on forward ends of the projections 70.

Figure 8:
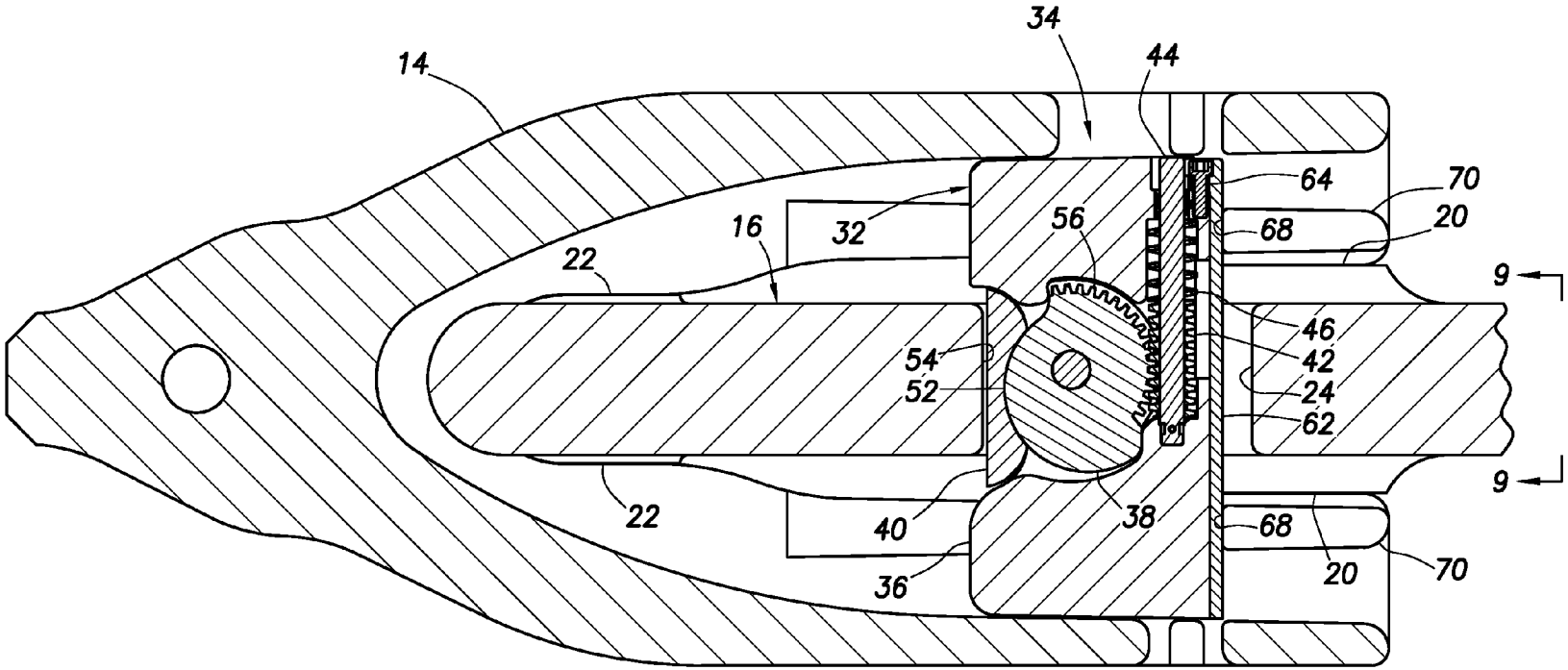
FIG. 8 is a representative cross-sectional view of the adapter and retainer, with the latch installed.

Referring additionally now to FIG. 8, the attachment system 34 is representatively illustrated with the latch 62 secured to the retainer body 36. Removal of the adapter 14 from the lip 16 is now prevented. However, the abutment 40 remains in its retracted position, and so the adapter 14 is not yet biased rearwardly by the retainer 32.

Referring additionally now to FIG. 9, a rear view of the adapter 14 on the lip 16, with the latch 62 installed, is representatively illustrated. In this view, the manner in which the latch 62 blocks the forward ends of the projections 70 can be clearly seen.

Referring additionally now to FIG. 10, a plan view of the retainer 32, with the latch 62 secured thereto, is representatively illustrated. In this view, the manner in which the dovetail tenon 60 and mortise 66 cooperate to securely position the latch 62 on the retainer body 36 can be clearly seen.

Figure 11:
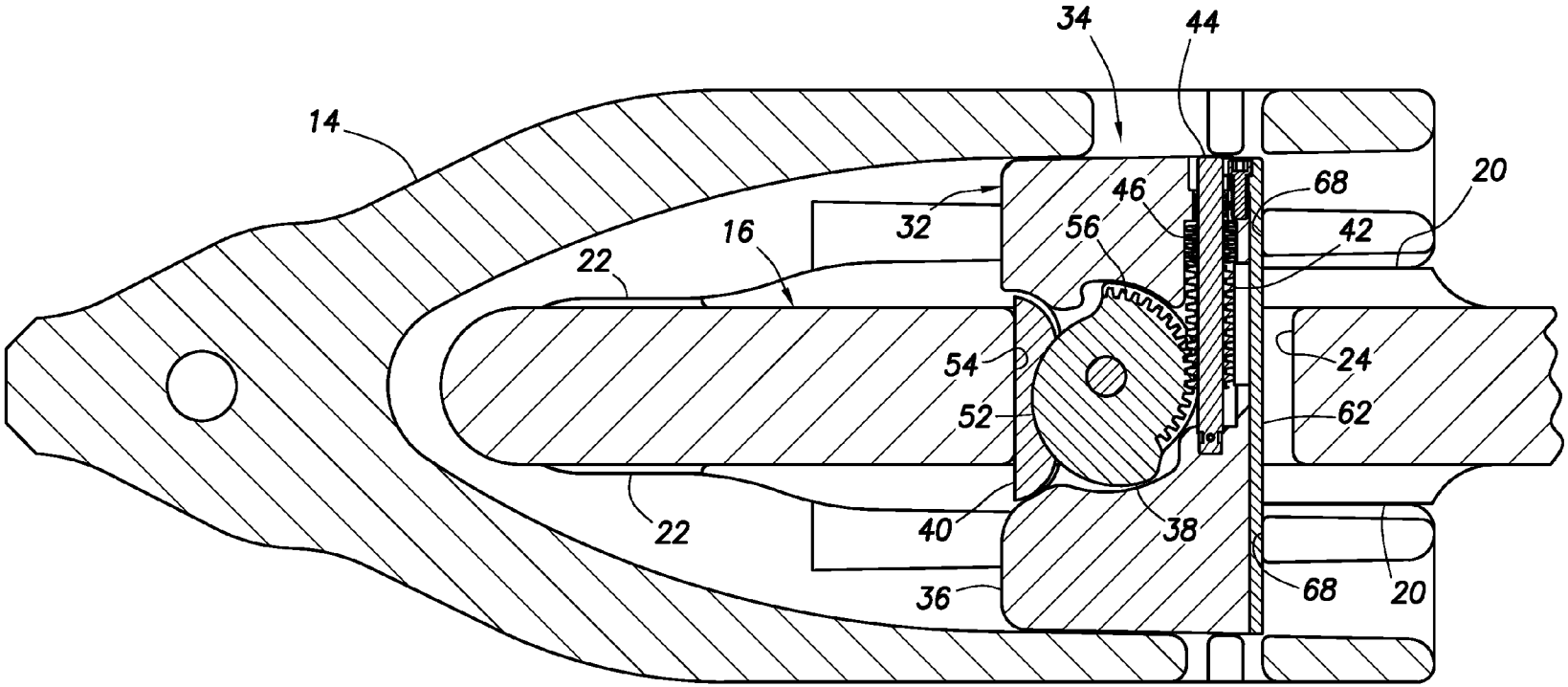
FIG. 11 is a representative cross-sectional view of the adapter and retainer, with an abutment of the retainer biased into engagement with the lip opening.

Referring additionally now to FIG. 11, the attachment system 34 is representatively illustrated after the cam 38 has been rotated to thereby displace the abutment 40 forward into contact with the forward side 54 of the opening 24. To rotate the cam 38, the shaft 44 is rotated about its axis 58 (see FIG. 4), thereby causing the threaded member 42 to rotate. Such rotation of the threaded member 42, along with cooperative engagement between the threaded member and the cam teeth 56, produces rotation of the cam 38.

As the cam 38 rotates, engagement between the cam surface 52 and the abutment 40 causes the abutment to displace in a forward direction relative to the retainer body 36. Eventually, the abutment 40 contacts the forward side 54 of the opening 24. At this point, further rotation of the cam 38 will increasingly bias the abutment 40 forward against the forward side 54 of the opening 24.

This forward biasing of the abutment 40 against the lip 16 produces a reactive rearward biasing of the retainer body 36 and latch 62. Contact between the latch 62 and the shoulders 68 transmits the rearward biasing to the adapter 14, so that the retainer is rearwardly biased relative to the lip 16. Thus, rotation of the cam 38 by rotation of the shaft 44 and threaded member 42 produces rearward biasing of the adapter 14 relative to the lip 16.

Continued rotation of the cam 38 after the abutment 40 has engaged the forward side 54 of the opening 24 (and the abutment is thereby prevented from further forward displacement relative to the body 36) results in a progressively increasing forward biasing force being applied to the abutment. Accordingly, more force must be applied to the cam teeth 56 via the threaded member 42, in order to produce a corresponding further rotation of the cam 38.

Eventually, the force exerted by the threaded member 42 to the cam teeth 56 exceeds the biasing force exerted by the biasing device 46, and the threaded member begins to displace upward (as viewed in FIG. 11) on the shaft 44. In the FIG. 11 example, the threaded member 42 has displaced upward relative to the shaft 44, thereby compressing the biasing device 46, which is in the form of a compression spring extending helically about the shaft.

As the biasing device 46 is compressed, the biasing force exerted by the biasing device increases. This increased biasing force is applied via the threaded member 42 to the cam teeth 56, with a resulting increased forward biasing force being applied to the abutment 40 via the cam surface 52.

Energy is stored in the biasing device 46 so that, even though wear may be experienced between the adapter 14 and the lip 16 in operation, the retainer 32 will continue to rearwardly bias the adapter into contact with the lip. Note that biasing devices other than compression springs may be used in other examples, without departing from the principles of this disclosure.

Referring additionally now to FIGS. 12-18, another example of the attachment system 34 is representatively illustrated. Since the FIGS. 12-18 example is similar in many respects to the FIGS. 4-11 example, the same reference numbers are used for similar elements in FIGS. 12-18.

Figure 12:
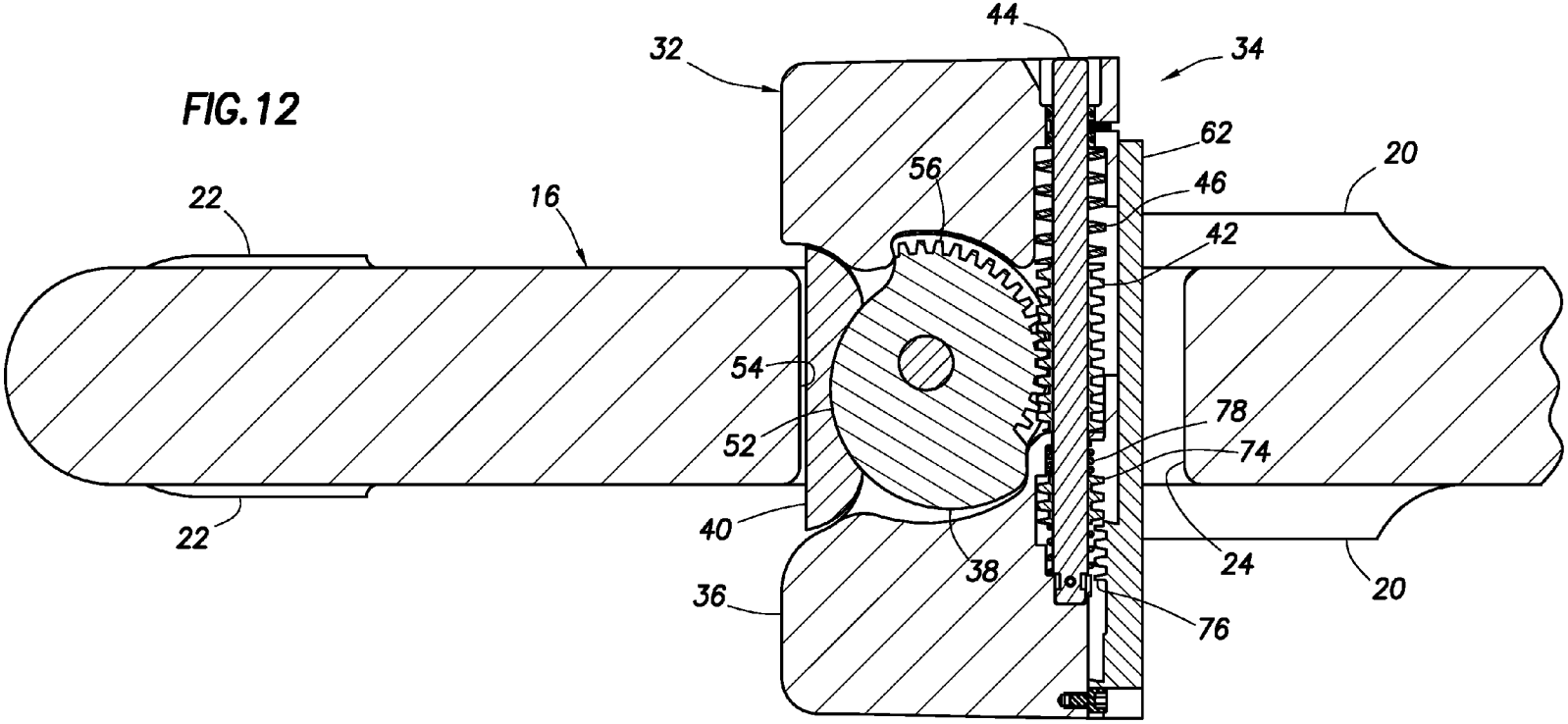
FIG. 12 is a representative cross-sectional view of another example of the retainer positioned in the lip opening.

In FIG. 12, the retainer 32 is depicted as being received in the opening 24 in the lip 16. The abutment 40 is in its retracted position at this point.

Note that, in addition to the threaded member 42 on the shaft 44, another threaded member 74 is reciprocably disposed on the shaft. The threaded member 74 rotates with the shaft 44, and can displace axially relative to the shaft, similar to the manner in which the threaded member 42 is arranged on the shaft. However, the threaded member 74 is used in this example to displace the latch 62 relative to the retainer body 36.

Instead of the latch 62 being initially separate from the body 36, and then secured to the body after the adapter 14 is installed (as in the FIGS. 4-11 example), the latch of the FIGS. 12-18 example is initially reciprocably disposed on the body and is displaced between engaged and disengaged positions in response to corresponding rotations of the threaded member 74. The threaded member 74 can engage teeth 76 formed on the latch 62 to thereby displace the latch between its engaged and disengaged positions.

In FIG. 12, the latch 62 is in its disengaged position. The threaded member 74 is biased downwardly (as viewed in FIG. 12) by a biasing device 78 so that, when the shaft 44 is appropriately rotated, the threaded member will fully engage the teeth 76 and displace the latch 62 upwardly to its engaged position, as described more fully below.

Figure 13:
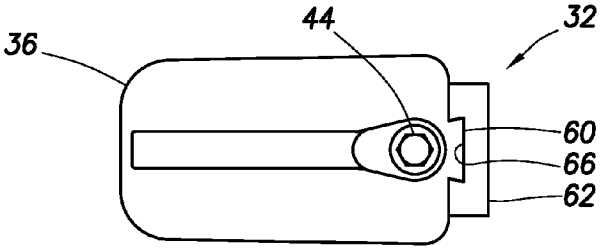
FIG. 13 is a representative plan view of the FIG. 12 retainer.

In FIG. 13, a plan view of the retainer 32 is representatively illustrated. In this view, the manner in which the tenon 60 and mortise 66 are initially engaged to slidingly secure the latch 62 to the body 36 can be readily seen.

Figure 14:
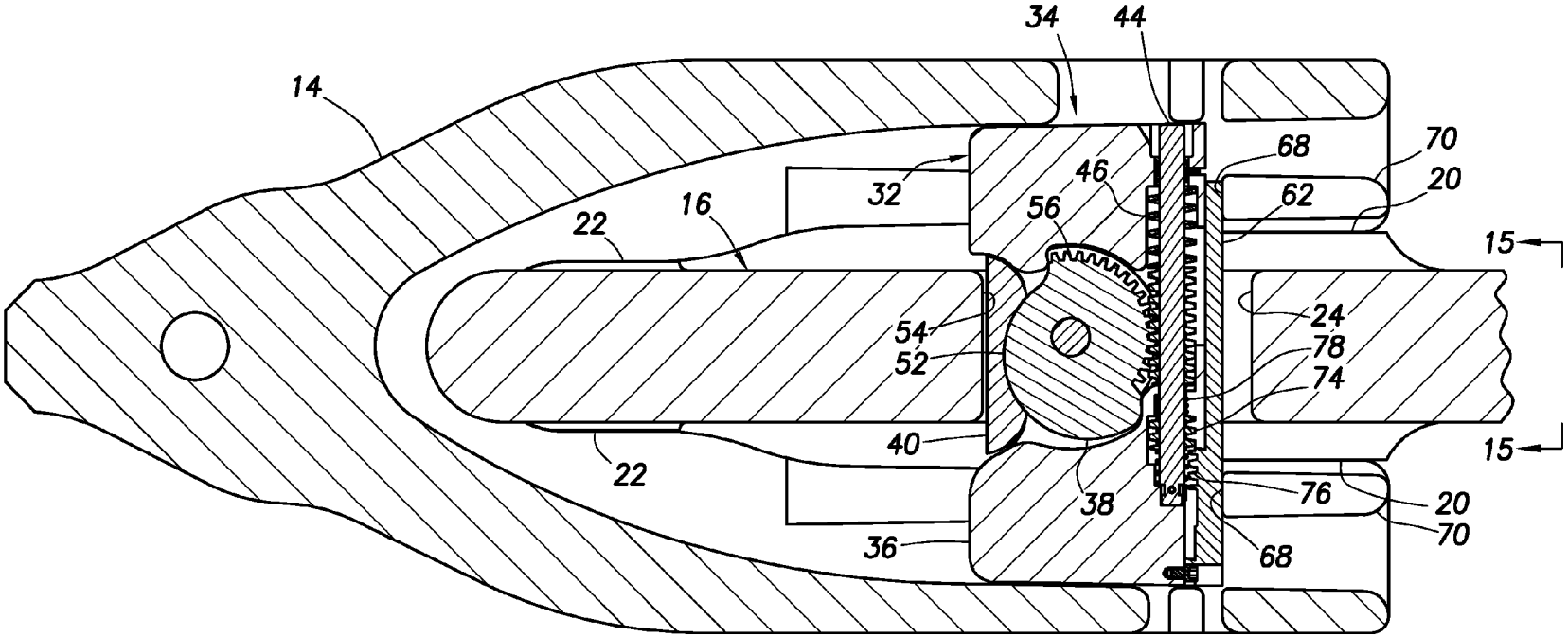
FIG. 14 is a representative cross-sectional view of the retainer and the adapter positioned on the lip section.

In FIG. 14, the attachment system 34 is representatively illustrated after the adapter 14 has been positioned on the lip 16. The latch 62 remains in its disengaged position, and so the retainer 32 does not yet prevent removal of the adapter 14 from the lip 16.

Figure 15:
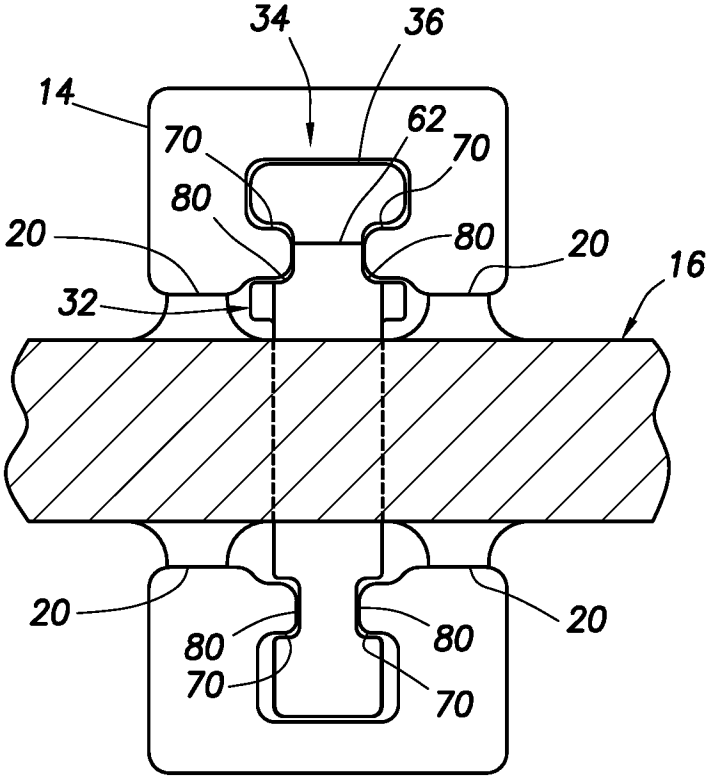
FIG. 15 is a representative rear view of the retainer and adapter, taken along line 15-15 of FIG. 14.

In FIG. 15, a rear view of the adapter 14 and retainer 32 is representatively illustrated. In this view, it may be seen that recesses 80 are formed on the latch 62, so that the latch does not yet contact the shoulders 68 (see FIG. 14) on the forward ends of the projections 70. Thus, at this point, the retainer 32 cannot rearwardly bias the adapter 14.

Figure 16:
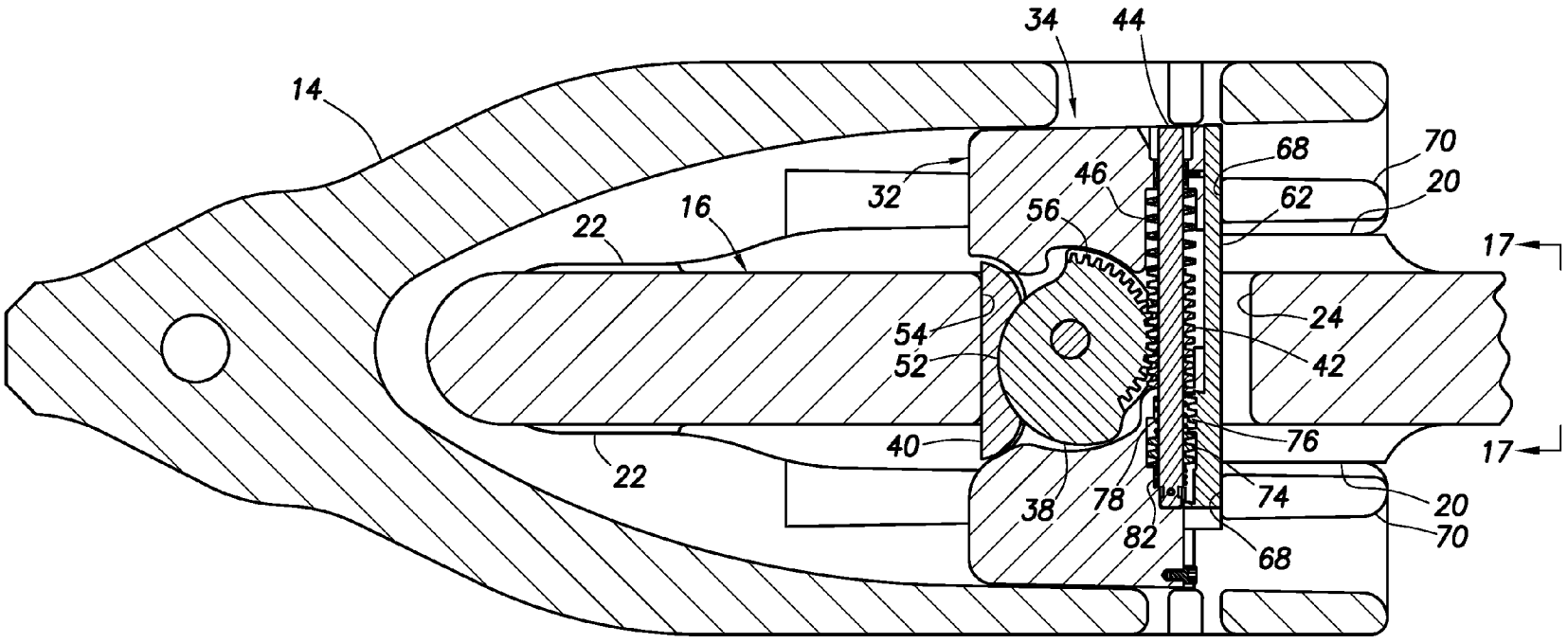
FIG. 16 is a representative cross-sectional view of the retainer and adapter, with a latch of the adapter displaced to an engaged position.

In FIG. 16, the shaft 44 has been rotated to displace the latch 62 to its engaged position, and to rotate the cam 38 so that the abutment 40 contacts the forward side 54 of the opening 24. Preferably, the threaded members 42, 74, teeth 56, 76, cam 38 and latch 62 are appropriately dimensioned so that the latch is in its engaged position prior to the abutment 40 exerting a forwardly biasing force on the forward side 54 of the opening 24.

Note that the threaded member 74 disengages from the teeth 76 on the latch 62 after the latch has been displaced to the engaged position. The threaded member 74 can displace axially downward (as viewed in FIG. 16) on the shaft 44 as it rotates, compressing a biasing device 82, until the threaded member disengages from the teeth 76.

Thus, when the latch 62 is displaced to its engaged position, continued rotation of the shaft 44 and threaded member 74 will cause the threaded member to displace downwardly against the biasing force exerted by the biasing device 82, until the threaded member disengages from the teeth 76. Thereafter, the biasing force urges the threaded member 74 toward engagement with the teeth 76, so that reversed rotation of the shaft 44 and threaded member 74 can be used to displace the latch 62 back to its disengaged position (see FIG. 14) when it is desired to remove the retainer 32 and/or adapter 14 from the lip 16.

Figure 17:
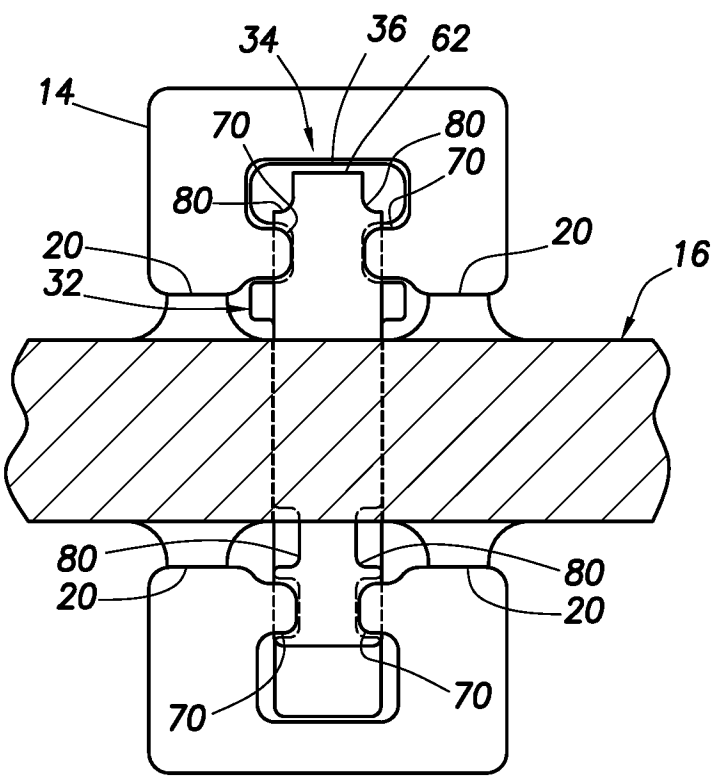
FIG. 17 is a representative rear view of the retainer and adapter, taken along line 17-17 of FIG. 16.

In FIG. 17, the manner in which the latch 62, in its engaged position, prevents removal of the adapter 14 from the lip 16 can be readily seen. In the upwardly displaced (as viewed in FIG. 17) engaged position of the latch 62, the recesses 80 are offset from the projections 70, and so the latch can engage the shoulders 68 (see FIG. 16) on the forward ends of the projections.

Figure 18:
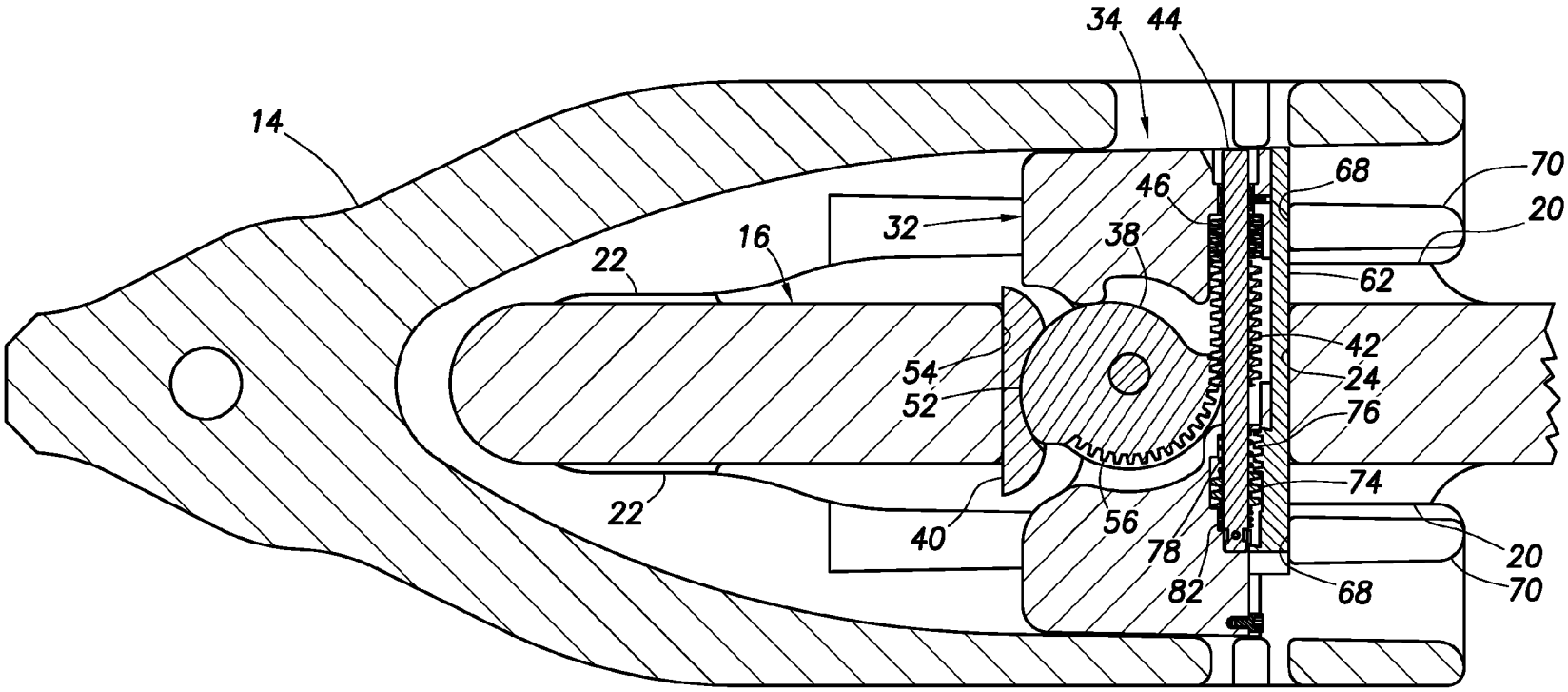
FIG. 18 is a representative cross-sectional view of the retainer and adapter, with the latch fully engaged, and with an abutment of the retainer biased into engagement with the lip opening.

In FIG. 18, the attachment system 34 is representatively illustrated after the cam 38 has been rotated to thereby bias the abutment 40 forward against the forward side 54 of the opening 24. To rotate the cam 38, the shaft 44 is rotated further (beyond that of FIG. 16), thereby causing the threaded member 42 to rotate further. Such rotation of the threaded member 42, along with cooperative engagement between the threaded member and the cam teeth 56, produces further rotation of the cam 38.

As the cam 38 rotates further, the engagement between the cam surface 52 and the abutment 40 increasingly biases the abutment forward against the forward side 54 of the opening 24. This forward biasing of the abutment 40 against the lip 16 produces a reactive rearward biasing of the retainer body 36 and latch 62.

Contact between the latch 62 and the shoulders 68 transmits the rearward biasing to the adapter 14, so that the adapter is rearwardly biased relative to the lip 16. Thus, the further rotation of the cam 38 by rotation of the shaft 44 and threaded member 42 produces rearward biasing of the adapter 14 relative to the lip 16.

Continued rotation of the cam 38 after the abutment 40 has engaged the forward side 54 of the opening 24 (and the abutment is thereby prevented from further forward displacement relative to the body 36) results in a progressively increasing forward biasing force being applied to the abutment. Accordingly, more force must be applied to the cam teeth 56 via the threaded member 42, in order to produce a corresponding further rotation of the cam 38.

Eventually, the force exerted by the threaded member 42 to the cam teeth 56 exceeds the biasing force exerted by the biasing device 46, and the threaded member begins to displace upward (as viewed in FIG. 18) on the shaft 44. In the FIG. 18 example, the threaded member 42 has displaced upward relative to the shaft 44, thereby compressing the biasing device 46.

As the biasing device 46 is compressed, the biasing force exerted by the biasing device increases. This increased biasing force is applied via the threaded member 42 to the cam teeth 56, with a resulting increased forward biasing force being applied to the abutment 40 via the cam surface 52. Energy is stored in the biasing device 46 so that, even though wear may be experienced between the adapter 14 and the lip 16 in operation, the retainer 32 will continue to rearwardly bias the adapter into contact with the lip.

Note that the threaded member 42 could disengage from the cam teeth 56 when the biasing device 46 is compressed a certain amount, if desired, so that a predetermined maximum biasing force (and resulting torque applied to the cam 38) is produced by rotation of the shaft 44 and threaded member 42. Alternatively, a predetermined torque can be applied to the shaft 44 to produce a desired rearwardly biasing force applied to the adapter 14.

It may now be fully appreciated that the above disclosure provides significant advancements to the art of attaching wear members to excavation implements. In examples described above, the attachment system 34 can be used to conveniently and reliably secure the adapter 14 or other wear member to the lip 16, and to maintain the adapter or other wear member rearwardly biased against the front of the lip for reduced wear.

The above disclosure provides to the art a wear member attachment system 34 for an excavation implement 10. In one example, the system 34 can comprise a retainer 32 including an abutment 40 that engages a forward side 54 of an opening 24 extending through a lip 16 of the excavation implement 10. The retainer 32 further includes a cam 38. Rotation of the cam 38 displaces the abutment 40 forward relative to a body 36 of the retainer 32.

The cam 38 may rotate about an axis 50 oriented lateral relative to the excavation implement lip 16.

Teeth 56 of the cam 38 can engage a threaded member 42 that rotates about an axis 58. The threaded member axis 58 may be orthogonal to an axis 50 about which the cam 38 rotates.

Teeth 56 of the cam 38 can engage a first threaded member 42. The first threaded member 42 may be reciprocably disposed on a shaft 44.

A second threaded member 74 may also be reciprocably disposed on the shaft 44. The second threaded member 74 can engage teeth 76 of a latch 62, and the latch 62 may displace in response to rotation of the shaft 44 and the second threaded member 74.

The latch 62 can displace to an engaged position, in which removal of a wear member 14, 28, 30 from the excavation implement lip 16 is prevented, in response to rotation of the shaft 44 and the second threaded member 74. The second threaded member 74 may disengage from the latch teeth 76 as the latch 62 displaces to the engaged position.

The rotation of the shaft 44 can continue to rotate the cam 38 and displace the abutment 40 forward, with the second threaded member 74 disengaged from the latch teeth 76. The system 34 can include a biasing device 78, 82 that biases the second threaded member 74 toward engagement with the latch teeth 76.

The teeth 56 of the cam 38 can engage a threaded member 42, and a biasing device 46 may exert a biasing force on the threaded member 42. The biasing force can increase in response to discontinued forward displacement of the abutment 40, and/or in response to displacement of the threaded member 42 on the shaft 44.

The biasing force may forwardly bias the abutment 40. The biasing device 46 can extend helically about the shaft 44.

Also provided to the art by the above disclosure is another example of a wear member attachment system 34 for an excavation implement 10. In this example, the system 34 comprises a retainer 32 including a cam 38 and an abutment 40. Rotation of the cam 38 displaces the abutment 40 outward relative to a body 36 of the retainer 32. The abutment 40 displacement is in a direction orthogonal to an axis 50 of rotation of the cam 38.

The cam axis of rotation 50 may be oriented lateral relative to a lip 16 of the excavation implement 10.

Teeth 56 of the cam 38 may engage a threaded member 42. An axis of rotation 58 of the threaded member 42 may be orthogonal to the cam axis of rotation 50.

A second threaded member 74 can engage teeth 76 of a latch 62. The latch 62 displaces to an engaged position, in which removal of a wear member 14, 28, 30 from the excavation implement 10 is prevented, in response to rotation of a shaft 44 and the second threaded member 74. The second threaded member 74 may disengage from the latch teeth 76 as the latch 62 displaces to the engaged position.

The rotation of the shaft 44 can continue to rotate the cam 38 and displace the abutment 40 in the direction, with the second threaded member 74 disengaged from the latch teeth 76. The biasing force may increase in response to discontinued displacement of the abutment 40 in the direction. The biasing force can bias the abutment 40 in the direction.

The retainer 32 may be received in an opening 24 extending through a lip 16 of the excavation implement 10.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A wear member attachment system for an excavation implement, the system comprising:

a retainer including an abutment that engages a forward side of an opening extending through a lip of the excavation implement, the retainer further including a cam, wherein rotation of the cam displaces the abutment forward relative to a body of the retainer, and wherein teeth of the cam engage a first threaded member that rotates about a first axis.

2. The system of claim 1, wherein the cam rotates about a second axis oriented lateral relative to the excavation implement lip.

3. The system of claim 1, wherein the first axis is orthogonal to a second axis about which the cam rotates.

4. The system of claim 1, wherein the first threaded member is reciprocably disposed on a shaft.

5. The system of claim 4, wherein a second threaded member is reciprocably disposed on the shaft.

6. The system of claim 5, wherein the second threaded member engages teeth of a latch, and wherein the latch displaces in response to rotation of the shaft and the second threaded member.

7. The system of claim 5, wherein the second threaded member engages teeth of a latch, wherein the latch displaces to an engaged position, in which removal of a wear member from the excavation implement lip is prevented, in response to rotation of the shaft and the second threaded member, and wherein the second threaded member disengages from the latch teeth as the latch displaces to the engaged position.

8. The system of claim 7, wherein the rotation of the shaft continues to rotate the cam and displace the abutment forward, with the second threaded member disengaged from the latch teeth.

9. The system of claim 7, further comprising a biasing device that biases the second threaded member toward engagement with the latch teeth.

10. The system of claim 4, further comprising a biasing device that exerts a biasing force on the first threaded member.

11. The system of claim 10, wherein the biasing force increases in response to discontinued forward displacement of the abutment.

12. The system of claim 10, wherein the biasing force increases in response to displacement of the first threaded member on the shaft.

13. The system of claim 10, wherein the biasing force forwardly biases the abutment.

14. The system of claim 10, wherein the biasing device extends helically about the shaft.

15. A wear member attachment system for an excavation implement, the system comprising:

a retainer including a cam and an abutment, and wherein rotation of the cam displaces the abutment outward relative to a body of the retainer, the abutment displacement being in a direction orthogonal to an axis of rotation of the cam, wherein teeth of the cam engage a first threaded member, wherein the first threaded member is reciprocably disposed on a shaft, and wherein a second threaded member is reciprocably disposed on the shaft.

16. The system of claim 15, wherein the cam axis of rotation is oriented lateral relative to a lip of the excavation implement.

17. The system of claim 15, wherein an axis of rotation of the first threaded member is orthogonal to the cam axis of rotation.

18. The system of claim 15, wherein the second threaded member engages teeth of a latch, and wherein the latch displaces in response to rotation of the shaft and the second threaded member.

19. The system of claim 15, wherein the second threaded member engages teeth of a latch, wherein the latch displaces to an engaged position, in which removal of a wear member from the excavation implement is prevented, in response to rotation of the shaft and the second threaded member, and wherein the second threaded member disengages from the latch teeth as the latch displaces to the engaged position.

20. The system of claim 19, wherein the rotation of the shaft continues to rotate the cam and displace the abutment in the direction, with the second threaded member disengaged from the latch teeth.

21. The system of claim 19, further comprising a biasing device that biases the second threaded member toward engagement with the latch teeth.

22. The system of claim 15, further comprising a biasing device that exerts a biasing force on the first threaded member.

23. The system of claim 22, wherein the biasing force increases in response to discontinued displacement of the abutment in the direction.

24. The system of claim 22, wherein the biasing force increases in response to displacement of the first threaded member on the shaft.

25. The system of claim 22, wherein the biasing force biases the abutment in the direction.

26. The system of claim 22, wherein the biasing device extends helically about the shaft.

27. The system of claim 15, wherein the retainer is received in an opening extending through a lip of the excavation implement.

28. The system of claim 27, wherein the abutment engages a forward side of the opening.

29. The system of claim 15, wherein the direction comprises a forward direction.

* * * * *